US005406667A

United States Patent [19]

Teufel et al.

[11] Patent Number: 5,406,667

[45] Date of Patent: Apr. 18, 1995

[54] REFILL SPONGE MOP WITH COMPOSITE CURVED WRINGER PLATE

[75] Inventors: Rainer B. Teufel, Columbus; Paul R. Burger, Milford, both of Ohio; Mary R. Holt, West Harrison, Ind.; Diana W. Juratovac; Thomas J. Ward, both of Columbus, Ohio

[73] Assignee: Vining Industries, Inc., Springfield, Ohio

[21] Appl. No.: 94,820

[22] Filed: Jul. 20, 1993

[51] Int. Cl.[6] ..... A47L 13/146

[52] U.S. Cl. ..... 15/119.2; 15/244.1

[58] Field of Search ..... 15/119.2, 119.1, 116.1, 15/116.2, 115, 244.1, 244.2, 244.3, 244.4

[56] References Cited

U.S. PATENT DOCUMENTS

| | | | |
|---|---|---|---|
| 2,199,147 | 4/1940 | Bates | 15/119.2 |
| 2,730,741 | 1/1956 | Gantz | 15/244.1 |
| 2,774,091 | 12/1986 | Greenleaf | 15/119 |
| 2,912,710 | 11/1959 | Vosbikian et al. | 15/119.2 |
| 3,014,230 | 12/1961 | Morgan | 15/119.2 |
| 3,050,761 | 8/1962 | Morgan | 15/1919 |
| 3,060,478 | 10/1962 | Silver | 15/244.1 |
| 3,484,888 | 12/1969 | Davis | 15/119.2 |
| 3,495,289 | 2/1970 | Heid | 15/119 |
| 4,285,086 | 8/1981 | Whyte | 15/119.2 |
| 4,324,016 | 4/1982 | Herbig | 15/119.2 |
| 4,509,224 | 4/1985 | Batchelor | 15/119 |
| 4,882,804 | 11/1989 | Lucas | 15/244 |

FOREIGN PATENT DOCUMENTS

| | | | |
|---|---|---|---|
| 986428 | 7/1951 | France | 15/119.2 |
| 1097173 | 4/1958 | France | 15/119.2 |
| 932579 | 7/1963 | United Kingdom | 15/119.2 |

*Primary Examiner*—David A. Scherbel
*Assistant Examiner*—Gary K. Graham
*Attorney, Agent, or Firm*—Panitch Schwarze Jacobs & Nadel

[57] ABSTRACT

A sponge mop head is provided which protects a scrub strip during wringing operations by the use of a composite curved wringer plate assembly which envelops the scrub strip while allowing the mopping solution to be expelled from the sponge. In addition, a turn lock system is provided on the sponge mop head for conveniently removing and replacing a sponge mop refill cartridge.

8 Claims, 3 Drawing Sheets

REFILL SPONGE MOP WITH COMPOSITE CURVED WRINGER PLATE

TECHNICAL FIELD

The present invention relates to sponge mops, and more particularly, to a mop having a composite curve wringer plate.

BACKGROUND ART

Sponge mops are generally known wherein a flat rectangular sponge or sponge like material is mounted on a base plate holder which is hinged to a flat pressure plate so that the two plates can be folded towards each other to expel excess liquid from the sponge.

Currently, some sponge mops also include a scrub strip generally made of a cloth-like textured material which is attached by an adhesive or conventional means to the sponge, allowing the user to perform a more abrasive action on a surface. Disadvantageously, present sponge mops heads are less effective when a scrub strip is present because a conventional flat pressure plate cannot fully compress the sponge.

In addition, the force of the pressure plate during wringing is destructive to the scrub strip, wearing it down and/or delaminating the strip from the sponge. For example, U.S. Pat. No. 2,774,091 issued to Greenleaf describes a curved wringer plate in the figures and in Col. 3, lines 58–64 to accommodate the bulk-up of a sponge during the wringing by longitudinal rollers. Despite the stated purpose of the curvature, the curved wringer plate in Greenleaf reduces the effectiveness of the wringing operation of the sponge. Moreover, the curved wringer plate of Greenleaf can not protect a scrub strip from tearing or delaminating during wringing. Therefore, there exists a need for wringer plates which will protect the scrub strip during wringing operations.

Another disadvantage with conventional sponge mops is that the sponge refill cartridges are often difficult to remove and replace. For example, U.S. Pat. No. 4,509,224 to Batchelor, utilizes a combination of screw nuts, shank heads and locking holes for connecting a sponge backing plate to a mop head. Disadvantageously, it appears from the Batchelor patent that each screw head has to be removed from each shank before replacing the sponge and then returned while attaching the new sponge to the mop.

Accordingly, it is an object of the present invention to provide a sponge mop head which will not damage a scrub strip during the wringing of the sponge.

It is another object of the present invention to provide a refillable sponge mop head in which the sponge refill cartridge is conveniently removed and replaced.

SUMMARY DISCLOSURE OF THE INVENTION

These and other objects are fulfilled by the present invention wherein a refillable sponge mop head is provided wherein the base plate is offset from a curved wringer plate which allows the wringing of the sponge without damaging or delaminating a scrub strip. In addition, a turn lock mechanism is provided for the convenient removal and replacement of a sponge refill cartridge on a base plate.

BRIEF DESCRIPTION OF THE INVENTION

BEST MODE FOR CARRYING OUT THE INVENTION

Figure 1:
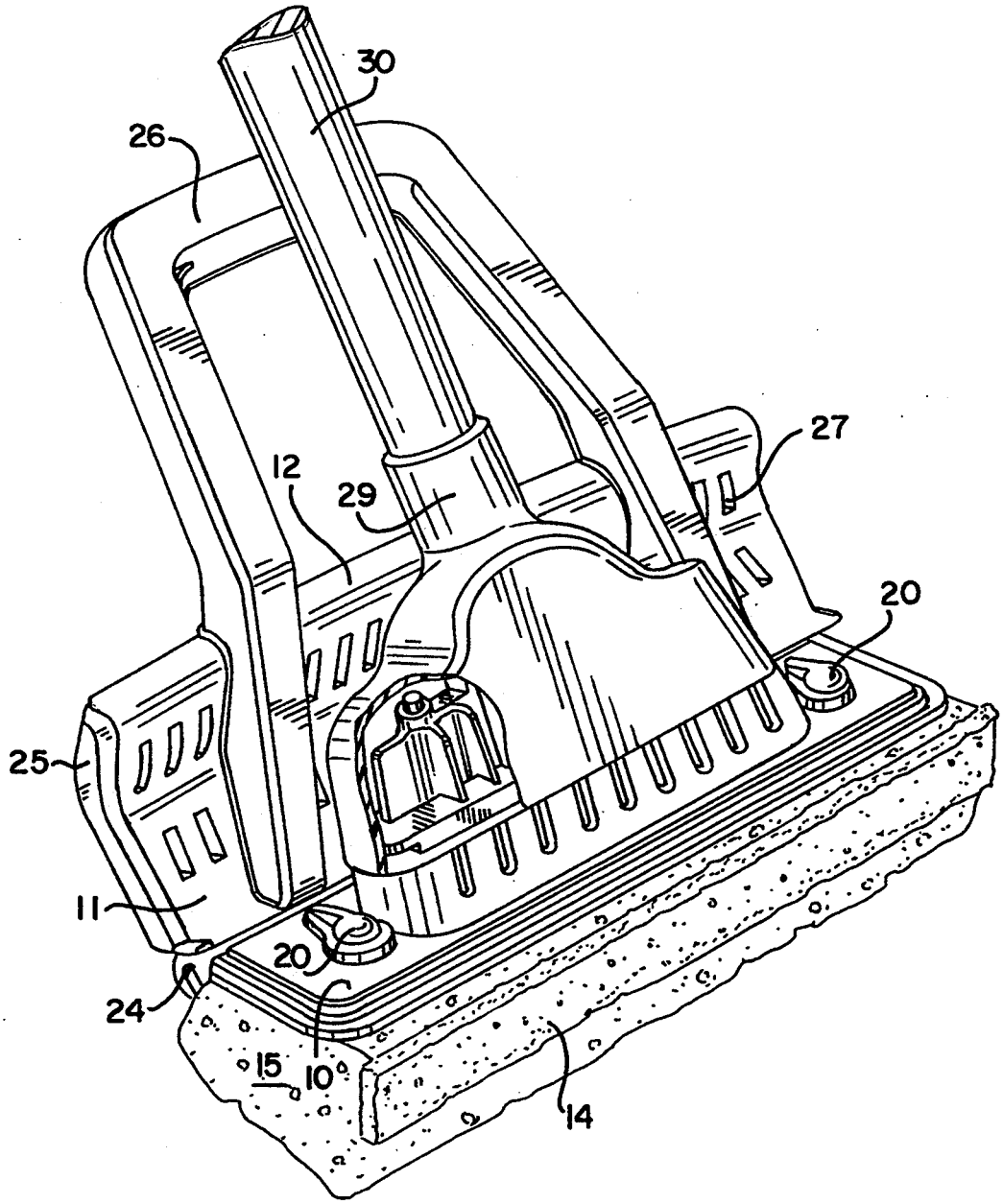
FIG. 1, is a front three-quarter perspective view of a sponge mop assembly with a sponge refill cartridge attached.
Figure 6:
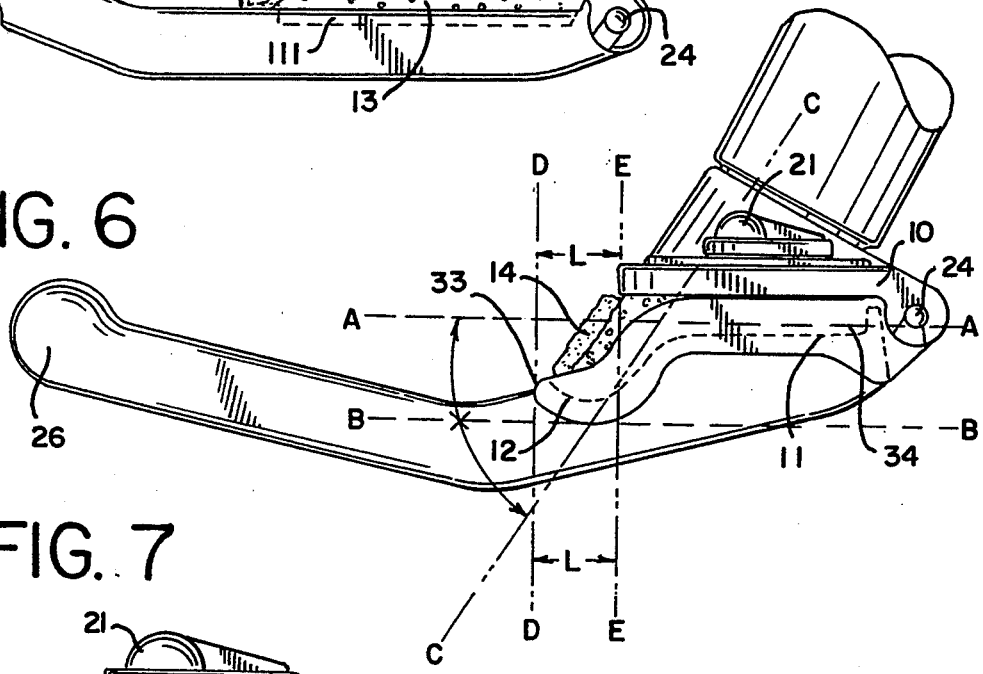
FIG. 6, is a side perspective view of the preferred curved wringer plate in compressive engagement with a sponge refill cartridge.

Referring to first FIGS. 1 and 6, the mop base plate and wringer plate of the present invention are shown generally at 10 and 11 respectively. These plates may be made of any suitable material such as a plastic, for example, a high density polyethylene or polypropylene. For reasons of economy and ease of molding, plastics such as high density polyethylene are preferred. The actual material from which these components are made forms no part of the present invention. These components are molded or otherwise manufactured in accordance with techniques which are well-known to those of ordinary skill in the art. The base plate 10 and wringer plate 11 are pivotably attached by conventional means, preferably hinge pins 24. In addition, a spring assembly, not shown, may be employed so that the wringer plate returns to its original, precompressed position once the pressure on the wringer plate is removed. Typically, the edge of the base plate 10 opposite the hinge is offset from the edge of wringer plate 11 opposite the hinge a distance of about 0.25 to about 1.25 inches, most preferably about 0.75 inches when the plates are in the compressed position, as shown in FIG. 6 as distance L between lines DD and EE.

Figure 2:
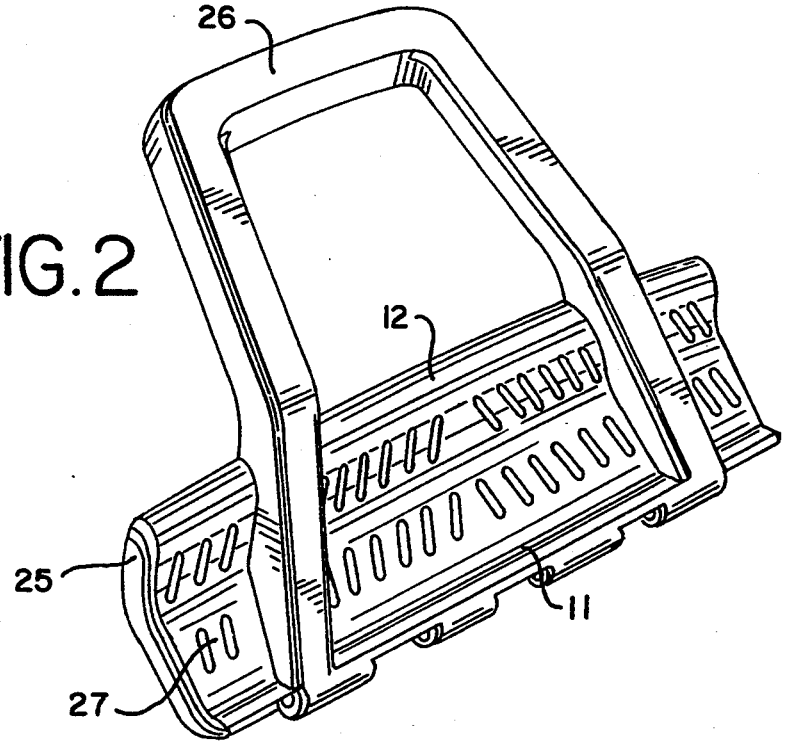
FIG. 2, is a front three-quarter perspective view of the preferred wringer plate.
Figure 4:
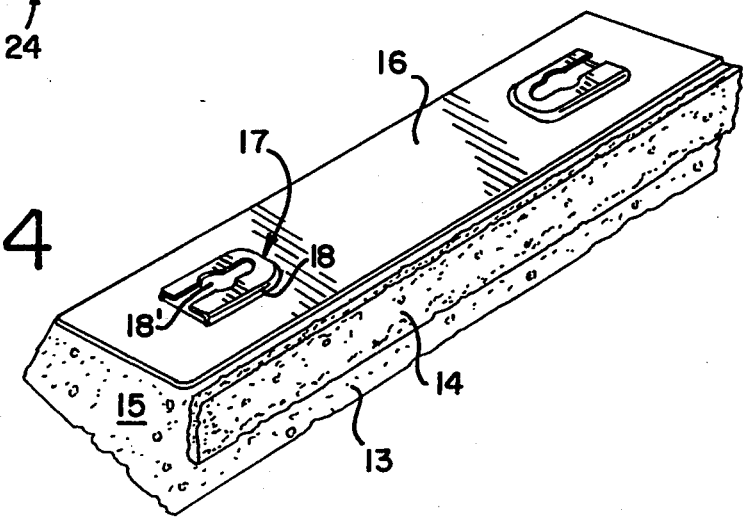
FIG. 4, is a front three-quarter perspective view of a sponge refill cartridge having a scrub strip.
Figure 5:
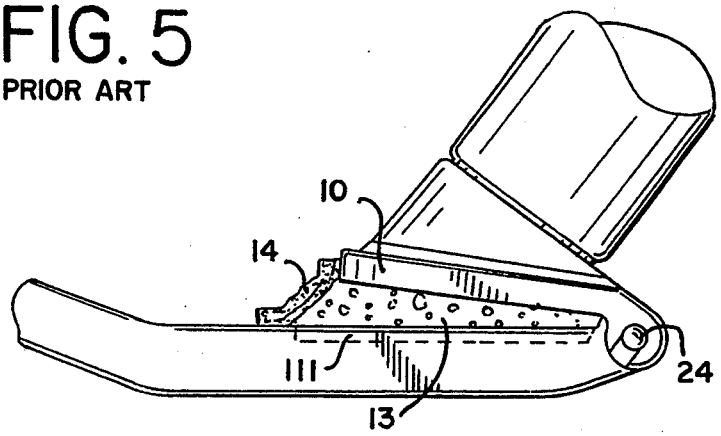
FIG. 5 PRIOR ART
FIG. 5, is a side perspective view of a conventional flat wringer plate in compressive engagement with a sponge refill cartridge.

Referring now to FIGS. 5, 2 and 6 wringer plate 11 is provided with a curvature which forms a pocket 12 disposed along one edge of the plate 11. Typically, the wringer plate 11 has an angle of curvature X, as shown in FIG. 6, at the intersection of AA and CC. Wringing surface 34 is parallel and offset between about 0.05 to about 0.5 inches, preferably about 0.25 inches to the base plate 10 to about the intersection of lines AA and CC, where an upward slope begins to form pocket 12. Line CC is parallel to the front surface 33 of pocket 12 or to a line tangent to a curve at the middle of front surface 33. The upward slope is tangent to the angle of curvature which forms pocket 12, preferably forming an "S" shaped wringer plate. Preferably angle X is about 47° to 67° , most preferably 57° . The upward slope generally begins at about 1.5 to about 3.0 inches, most preferably about 1.875 inches from the center of the hinge pin 24. When wringer plate 11 is compressed against the sponge 13, the pocket 12 envelops the scrub strip 14 of the sponge refill cartridge of FIG. 4, thus protecting the scrub strip 14 from delamination and tearing. A conventional flat wringer plate, as shown in FIG. 5, tends to put undue pressure on the scrub strip 14 causing delamination and tearing of the strip.

The wringer plate 11 as shown in FIGS. 1 and 2 may also contain end walls 25 along its edges which are curved so as to minimize the outward splashing or spraying of mopping solution when the sponge is compressed. Further, as shown in FIGS. 1 and 2, the wringer plate 11 may further comprise a handle 26 for more convenient compression of wringer plate 11 against the sponge 14 during wringing operations. The handle is preferably one which is easy to use, i.e. "ergonomic", such that a natural motion may be made by the mop user in order to move the handle when wringing the mop. Most preferably, the handle is U-shaped.

As an alternative embodiment, not shown, there is a rib on the back surface of the wringer plate at each point where the handle intersects the edge of the wringer plate opposite the hinge in order to prevent the washing solution from leaking out onto the user from the handle.

In addition, and as shown in FIGS. 1 and 2 the wringer plate 11 may also contain a number of apertures 27 therethrough to allow an even flow of mopping solution from the sponge during the wringing operation.

Figure 3:
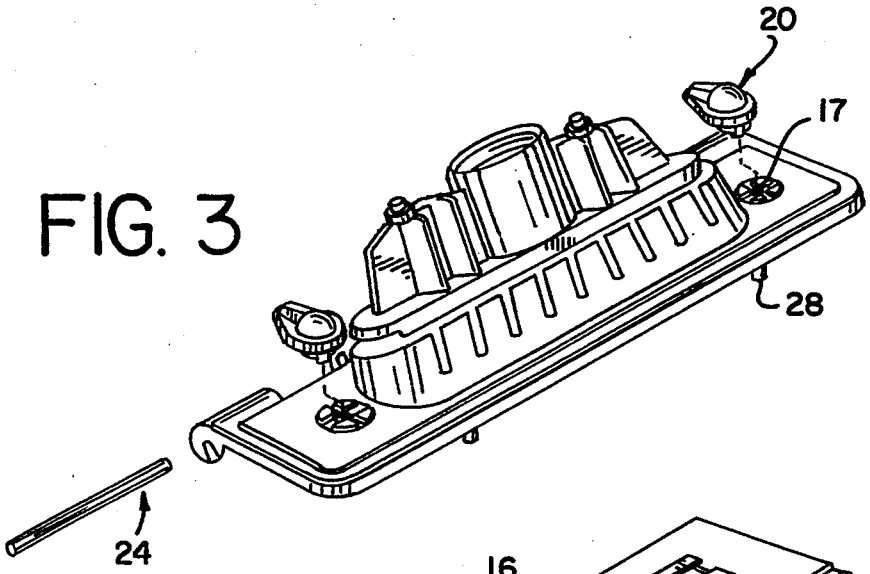
FIG. 3, is a front three-quarter perspective view of the preferred base plate.
Figure 7:
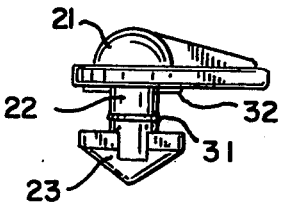
FIG. 7, is a side perspective view of a preferred turn lock assembly.
Figure 8A:
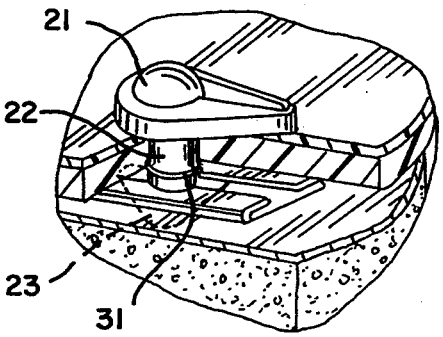
FIG. 8A, is an exploded three-quarter perspective view of the turn lock assembly positioned in the locking clip of the back plate of the sponge refill in order to remove a sponge mop refill cartridge.
Figure 8B:
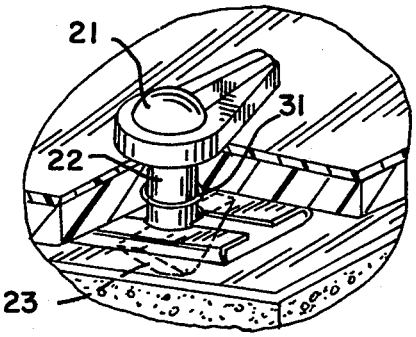
FIG. 8B, is an exploded three-quarter perspective view of the turn lock assembly in a locked position within the locking clip of the back plate of the sponge refill cartridge.

Further, as shown in FIGS. 1 and 3 the base plate 10 may also be provided with a turn lock assembly for attaching a sponge refill cartridge to the mop head. This assembly comprises a locking hole 19 which extends through the top and bottom of the base plate 10, and a turn lock 20, positioned inside the locking hole 19. As shown in FIG. 7, the turn lock comprises a knob 21 positioned on the top of the locking hole; a pivot 22 connected to the knob and extending through the locking hole 19; a retaining ring 31 which holds the pivot 22 in the base plate so that the turn lock assembly does not become dislodged and lost when the sponge refill cartridge is not attached; and a locking finger 23 extending transversely from the pivot. As shown in FIG. 8B, the locking finger 23 is engaged within the keyways 18' of a locking clip 17 of the sponge refill cartridge 15 of FIG. 4 when the knob 21 is rotated a predetermined number of degrees, preferably 90° in one direction and is released, as shown in FIG. 8A, when the knob 21 is rotated a predetermined number of degrees in the opposite direction, preferably 90°. This lock assembly allows the sponge refill cartridge 15 to be conveniently replaced while keeping the sponge in place during the use of the mop.

As an alternative embodiment, not shown, there is at least one locking projection 32 positioned between the turn lock knob 20 and the retaining ring 31 which fits into a corresponding dimple (not shown) in the locking hole in the locked position, in order to assure the user that the turn lock assembly is in the locked position.

The base plate 10 as shown in FIG. 3 may further comprise at least one aligning pin 28 which allows the user to line up the locking clip 18 of the sponge refill cartridge 15 with the locking finger 23 of the turn lock assembly. The base plate may also comprise a handle receptacle 29 and a handle 30 for more convenient use of the mop.

The sponge back plate 16 of the sponge refill cartridge 15 shown in FIG. 4 is preferably constructed of thermoplastic materials such as polyolefins, and PVC so as to permit the sponge 13, which is typically formed from a synthetic plastic, to be thermally sealed to the back plate 16. This allows the use of heat or ultrasonic welding to attach the sponge 13 to the plate 16 in addition to adhesive and mechanical fasteners.

INDUSTRIAL APPLICABILITY

Therefore, the same curved wringer plate can be used with a variety of different sponge mop head assemblies to economically produce a number of different sponge mops having different appearances.

Other modifications and variations to the present invention will become apparent to those skilled in the art from an examination of the above specifications and Drawings. Therefore, other variations of the present invention may be made which fall within the scope of the appended claims even though such variations were not specifically discussed above.

What we claim is:

1. A refillable sponge mop head comprising:

a base plate having a first side, a second, opposing side, a base hinge edge and a base opposing edge;

a wringer plate having a first side, a second, opposing side, a wringer hinge edge and a wringer opposing edge;

a sponge attached to said base plate first side, said sponge having a front face portion;

a scrub strip attached to said front face portion of said sponge; and a pivot connecting said base hinge edge and said wringer hinge edge for pivoting said plates with respect to each other about an axis that is fixed relative to said plates, such that said base plate and said wringer plate can be brought into an engaged position wherein said wringer plate first side contacts said sponge such that said sponge is compressed between said base plate first side and said wringer plate first side, said wringer plate first side having scrub strip receiving means, which defines an arcuate region, for receiving said scrub strip, said arcuate region having a generally convex curvature so that when said plates are in said engaged position, said arcuate region receives said scrub strip and prevents said scrub strip from being compressed;

a sponge refill cartridge for being releasably secured to said base plate, said refill cartridge having a sponge back plate, said sponge back plate being secured to a top side of the sponge;

a sponge back fastener connected to said sponge back plate comprising a locking clip defining keyways;

at least one locking hole extending through the first and second sides of said base plate; and at least one turn lock comprising:

(1) a knob on said locking hole;

(2) a pivot connected to said knob, said pivot extending through said locking hole; and (3) a locking finger extending transversely from said pivot and which is engaged within said locking clip when said knob is disposed in a first rotary orientation and is released from engagement within said locking clip when said knob is disposed in a second rotary orientation.

2. A refillable sponge mop head, comprising:

a base having a first side, a second, opposing side, a base hinge edge and a base opposing edge;

a wringer plate having a first side, a second, opposing side, a wringer hinge edge and a wringer opposing edge;

a sponge attached to said base plate first side, said sponge having a front face portion;

a scrub strip attached to said front face portion of said sponge; and a pivot connecting said base hinge edge and said wringer hinge edge for pivoting said plates with respect to each other about an axis that is fixed relative to said plates, such that said base plate and said wringer plate can be brought into an engaged position wherein said wringer plate first side contacts said sponge such that said sponge is compressed between said base plate first side and said wringer plate first side, said wringer plate first side having scrub strip receiving means, which defines an arcuate region, for receiving said scrub strip, said arcuate region having a generally convex curvature so that when said plates are in said engaged position, said arcuate region receives said scrub strip and prevents said scrub strip from being compressed.

3. The refillable sponge mop head as claimed in claim 2, wherein said wringer plate further comprises end walls along its perimeter for minimizing outward splashing of a mopping solution liquid during wringing.

4. The refillable sponge mop head as claimed in claim 2, wherein said wringer plate further comprises a handle having a surface area sufficient to accommodate a hand, which assists in pivoting said wringer plate into compressible engagement with said base plate.

5. The refillable sponge mop head as claimed in claim 4, wherein said wringer plate handle is U-shaped.

6. The refillable sponge mop head as claimed in claim 2, wherein said wringer plate and said arcuate region of said wringer plate has an arc in the range from approximately 47° to approximately 67° .

7. The refillable sponge mop head as claimed in claim 1, wherein said arcuate region of the wringer plate has an arc of about 57° .

8. The refillable sponge mop head as claimed in claim 2, wherein said pivot defines an axis line and the dimensions of said plates are selected such that said base opposing edge is radially offset a first predetermined distance from said axis line and said wringer opposing edge is radically offset a second predetermined distance from said axis line when said plates are in said engaged position.

* * * * *